United States Patent [19]

Huber et al.

[11] 4,389,985

[45] Jun. 28, 1983

[54] APPARATUS FOR ESTABLISHING AND TERMINATING CONNECTIONS BETWEEN CRANKSHAFTS

[75] Inventors: Lothar Huber, Bühl-Altschweier; Oswald Friedmann, Lichtenau, both of Fed. Rep. of Germany

[73] Assignee: Luk Lamellen und Kupplungsbau GmbH, Bühl, Fed. Rep. of Germany

[21] Appl. No.: 233,952

[22] Filed: Feb. 12, 1981

[30] Foreign Application Priority Data

Feb. 13, 1980 [DE] Fed. Rep. of Germany ..... 2005369

[51] Int. Cl.[3] ..... F02B 75/18

[52] U.S. Cl. ..... 123/198 F; 123/52 A; 192/85 A

[58] Field of Search ..... 123/198 F, 52 A; 192/53 B, 85 A

[56] References Cited

U.S. PATENT DOCUMENTS 4,069,803 1/1978 Cataldo ..... 123/198 F

FOREIGN PATENT DOCUMENTS 2828298 1/1980 Fed. Rep. of Germany ... 123/198 F

*Primary Examiner*—Tony M. Argenbright

*Attorney, Agent, or Firm*—Kontler, Grimes & Battersby

[57] ABSTRACT

An internal combustion engine wherein a first crankshaft is driven by a first group of cylinders and a second crankshaft which is coaxial with the first crankshaft can be driven by a second group of cylinders upon acceleration to the speed of the first crankshaft. The first crankshaft drives a first camshaft which is coaxial with a second camshaft serving to drive the second crankshaft in the absence of a direct connection between the two crankshafts. A friction clutch between the two camshafts gradually accelerates the second crankshaft to the speed of the first crankshaft and is thereupon disengaged whereby a positive engagement clutch connects the second crankshaft to the first crankshaft. The second crankshaft can be coupled to the first crankshaft only when the two crankshafts are held in predetermined angular positions relative to each other.

42 Claims, 3 Drawing Figures

APPARATUS FOR ESTABLISHING AND TERMINATING CONNECTIONS BETWEEN CRANKSHAFTS

CROSS-REFERENCE TO RELATED CASE

Certain features of the apparatus which is disclosed in the present case are referred to in the commonly owned copending application Ser. No. 233,960 filed Feb. 12, 1981 by Paul Maucher et al. for "Internal combustion engine with separable crankshafts" and in the commonly owned copending application Ser. No. 233,890 filed Feb. 12, 1981 by Lothar Huber for "Method and apparatus for separably connecting crankshafts in internal combustion engines".

BACKGROUND OF THE INVENTION

The present invention relates to internal combustion engines in general, and more particularly to improvements in apparatus for saving energy during operation of internal combustion engines. Still more particularly, the invention relates to improvements in apparatus for coupling a second crankshaft to, or for disconnecting the second crankshaft from, a first crankshaft in order to save fuel for operation of internal combustion engines.

It is already known to save fuel by disconnecting one or more cylinders of a multi-cylinder internal combustion engine when the engine is to operate at partial load. For example, German Offenlegungsschrift No. 28 28 298 discloses a method of operating an internal combustion engine which has several cylinders installed in a common block. The engine further comprises several crankshafts including a first crankshaft in a first engine section embodying a first group of cylinders and a second crankshaft in a second engine section embodying a second (e.g., the remaining) group of cylinders. When the engine is operated at partial load, the second group of cylinders is deactivated by disengaging the corresponding (second) crankshaft from the other (first) crankshaft. In order to restart the temporarily deactivated section, the second crankshaft must be coupled to the first crankshaft in such a way that the two crankshafts will be maintained in predetermined angular positions with reference to each other to thereby ensure firing of the cylinders in proper sequence.

OBJECTS AND SUMMARY OF THE INVENTION

An object of the invention is to provide a novel and improved apparatus for selective coupling of a second crankshaft to a first crankshaft and for disengagement of the second crankshaft from the first crankshaft in a space-saving mannner and with a minimum of wear upon the motion transmitting parts.

Another object of the invention is to provide the apparatus with novel and improved means for establishing a torque transmitting connection between the crankshafts in a manner such that the establishment of connection is least likely to result in excessive wear upon and/or damage to the torque transmitting components.

A further object of the invention is to provide novel and improved clutch means for use in an apparatus of the above outlined character.

An additional object of the invention is to provide novel and improved means for accelerating one of several crankshafts in an internal combustion engine to the RPM of a continuously driven crankshaft in the same engine.

A further object of the invention is to provide novel and improved torque transmitting connections between the rotary components of several sections of an internal combustion engine.

An ancillary object of the invention is to provide a novel and improved clutch between discrete camshafts of an internal combustion engine of the type wherein each of several groups of cylinders can rotate a discrete crankshaft.

A further object of the invention is to provide a simple, rugged and reliable separable connection between the crankshafts of an internal combustion engine wherein each of the crankshafts can be rotated by a discrete cylinder or a discrete group of cylinders.

Another object of the invention is to provide the apparatus with novel and improved means for accurately timing the establishment of a connection between the crankshafts and for ensuring that the crankshafts are invariably coupled in proper angular positions relative to each other.

The invention resides in the provision of an apparatus for connecting or disconnecting first and second sections or units of an internal combustion engine (each such section can comprise a group of cylinders which are installed in a common cylinder block or a common casing). More specifically, the apparatus comprises first and second rotary crankshafts which respectively form part of the first and second sections of the engine, accelerating means operable to raise the speed of the second crankshaft to at least approximate the speed of the first crankshaft (it being assumed here that the first crankshaft is driven whenever the engine is on, i.e., regardless of the number of cylinders which are in use), and positive-engagement clutch means which is operative to positively couple the crankshafts to each other upon completed acceleration of the second crankshaft to the speed of the first crankshaft.

The accelerating means comprises or may comprise a camshaft which receives torque from the first crankshaft (e.g., by way of a gear train) and constitutes the input element of the accelerating means. The accelerating means may further comprise a second camshaft, means (e.g., a gear train) for transmitting torque from the second camshaft to the second crankshaft and a dry friction clutch or other suitable means for transmitting torque from the first to the second camshaft.

If the first and second crankshafts are coaxial with each other, they preferably have end portions which are adjacent to each other. The positive-engagement clutch means then preferably comprises a first clutch member which is driven by the end portion of the first crankshaft and has a first (e.g., toothed) profile facing the end portion of the second crankshaft, a second clutch member driven by the end portion of the second crankshaft and having a second (e.g., toothed) profile complementary to the first profile, and means (e.g., a set of springs) for axially movably securing at least one of the clutch members to the respective crankshaft so that the profile of the one clutch member can move into positive engagement with the profile of the other clutch member in response to movement of the one clutch member relative to the crankshafts. The apparatus then further comprises control means (e.g., control means including a plate-like member which is movable in parallelism with the axes of the crankshafts) for moving the one clutch member toward the other clutch member in response to completed acceleration of the second crankshaft. Still further, the apparatus preferably comprises means for maintaining the control means in a first predetermined position (in which the one clutch member is disengaged from the other clutch member) while the angular velocity of the second crankshaft deviates from the angular velocity of the first crankshaft. The apparatus preferably also comprises means for moving or for effecting the movement of the control means to another predetermined position (in which the one clutch member engages with the other clutch member) in response to completed acceleration of the second crankshaft to the speed of the first crankshaft.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
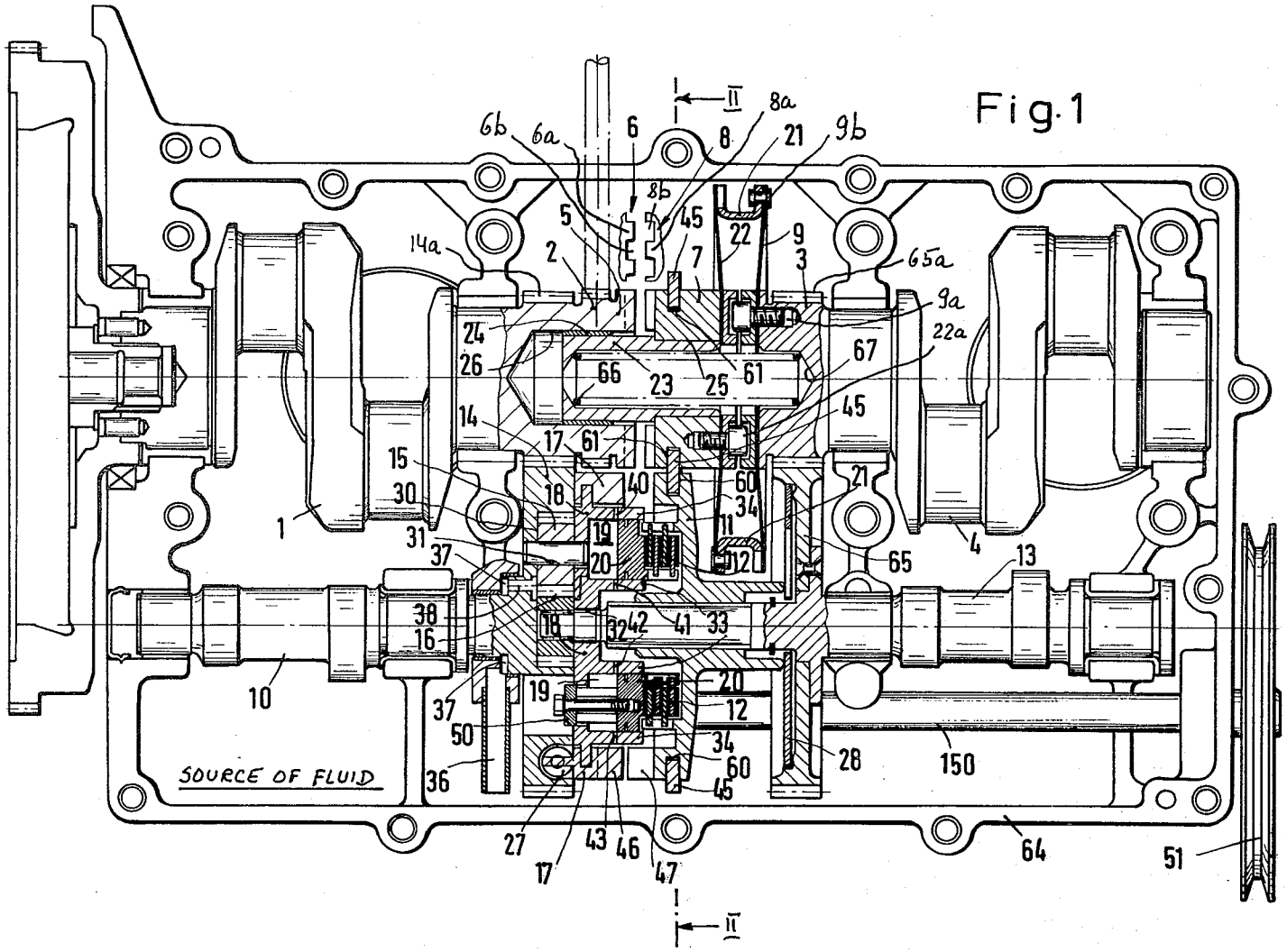
FIG. 1 is a partly elevational and partly longitudinal sectional view of an apparatus which embodies one form of the invention.

Referring first to FIG. 1, there is shown a first crankshaft 1 which is coaxial with a second crankshaft 4. That end portion 2 of the crankshaft 1 which is adjacent to and faces the crankshaft 4 carries a first clutch member 5 which has a profile 6 facing the crankshft 4 and consisting of alternating hills and valleys or teeth 6*a* and tooth spaces 6*b* shown in the middle of the upper portion of FIG. 1. The spaces 6*b* between the teeth 6*a* extend in parallelism with the axis of the crankshaft 1. The teeth 6*a* form an annulus which is concentric with the annulus of tooth spaces 6*b* and the centers of the two annuli are located on the axis of the crankshaft 1.

The clutch member 5 on the end portion 2 of the crankshaft 1 can be engaged with or disengaged from a second clutch member 7 which is indirectly connected to and is coaxial with the crankshaft 4. That end face of the clutch member 7 which faces the clutch member 5 has a profile 8 which is complementary to the profile 6 and also includes annuli of alternating hills and valleys or teeth 8*a* and tooth spaces 8*b*. When the clutch member 7 is moved axially of the crankshaft 4 in a direction toward the crankshaft 1, the teeth 8*a* penetrate into the tooth spaces 6*b* and the teeth 6*a* penetrate into the tooth spaces 8*b*. FIG. 1 shows the positive-engagement clutch including the clutch members 5 and 7 in disengaged condition, i.e., the profile 8 is remote from the profile 6 and the crankshaft 1 can rotate independently of the crankshaft 4 or vice versa.

If desired, the profiles 6 and 8 can be designed in such a way that the clutch member 7 can move into engagement with the clutch member 5 only in a single predetermined angular position of the crankshaft 1 with respect to the crankshaft 4 or in a relatively small number of predetermined angular positions. This can be readily achieved by providing the profile 6 with teeth 6*a* and tooth spaces 6*b* of varying width and/or length or depth (as considered in the circumferential and/or axial direction of the crankshaft 1), and by imparting to the profile 8 a similar configuration, i.e., by ensuring that each tooth 6*a* can enter only a predetermined tooth space 8*b* or one of a limited number of tooth spaces 8*b*, and that each tooth 8*a* can enter only a predetermined tooth space 6*b* or one of a limited number of tooth spaces 6*b*. Thus, if the clutch members 5 and 7 are to engage in two or more different angular positions whose total number is less than the number of teeth 6*a* or 8*a*, the profiles 6 and 8 will include two or more identical halves, thirds, fourths, etc. During engagement of a clutch which is designed in the just described manner (so that the teeth 6*a* and 8*a* have different widths and/or lengths, as considered in the circumferential direction and/or the direction of the common axis of the camshafts 1 and 4, the engagement takes place after a certain amount of ratcheting of teeth 6*a* along the teeth 8*a* and vice versa, i.e., until the teeth 6*a* find tooth spaces 8*a* of appropriate width and/or depth and the teeth 8*a* also find tooth spaces 6*b* of requisite width and/or depth.

The clutch member 7 is indirectly connected to the crankshaft 4 in such a way that it shares all angular movements of the crankshaft 4 but is movable axially with respect thereto. The means for securing the clutch member 7 to the crankshaft 4 comprises composite resilient means including at least one first leaf spring 9 and at least one second leaf spring 22. Each of these springs is preferably a ring-shaped (dished) spring and can be flexed to the right or to the left, as considered in FIG. 1, but cannot be flexed in the circumferential direction of the crankshaft 4. The inner marginal portion of the spring 9 shown in FIG. 1 (as considered in the radial direction of the crankshaft 4) is non-rotatably connected to the front end portion 3 of the crankshaft 4 (the end portion 3 is that portion which is nearest to the clutch member 5 on the end portion 2 of the crankshaft 1) by screws, bolts or analogous fasteners 9*a*. The radially outermost or outer marginal portion of the spring 9 is connected with the radially outermost or outer marginal portion of the associated spring 22 by a connector 21 which is or may constitute a ring having a U-shaped cross-sectional outline. One flange of of the ring-shaped connector 21 is attached (e.g., riveted) to the radially outermost portion of the leaf spring 9, and the other flange of the connector 21 is secured (e.g., riveted) to the radially outermost portion of the leaf spring 22. The radially innermost or inner marginal portion of the leaf spring 22 is bolted, screwed or otherwise non-rotatably fastened (as at 22*a*) to that end face of the clutch member 7 which faces the end portion 3 of the crankshaft 4. The configuration and initial stressing of the leaf springs 9 and 22 are such that, in the absence of the application of any outside force, they maintain the clutch member 7 in the position which is shown in FIG. 1, i.e., the clutch member 7 is disengaged from the clutch member 5 on the crankshaft 1.

The apparatus of FIG. 1 further comprises means for centering the clutch member 7 with respect to the clutch member 5, i.e., with respect to the crankshafts 1 and 4. The centering means comprises a hollow cylindrical centering member 23 the right-hand portion of which extends into an axial bore 25 machined into the clutch member 7. The mounting of the centering member 23 is preferably such that it shares the angular movements of the clutch member 7 and crankshaft 4. The left-hand portion of the centering member 23 extends into an axial bore 26 which is machined into the right-hand end face of the clutch member 5 on the crankshaft 1. The bore 26 contains a cylindrical bearing sleeve 24 which surrounds the left-hand portion of the centering member 23 and allows the latter to move axially of the clutch member 5.

The axial bore of the centering member 23 accommodates a helical spring 66 which is installed in prestressed condition in such a way that it reacts against a conical internal shoulder of the centering member 23 and bears against the bottom surface in an axial bore 67 machined into the left-hand end face of the end portion 3 of the crankshaft 4. Thus, the spring 66 constitutes an energy storing device which permanently urges the clutch member 7 in a direction toward the clutch member 5 because the centering member 23 shares the movements of the clutch member 7. The clutch member 7 assumes an accurately defined position because it is always centered by the member 23. The latter further ensures that the clutch member 7 is mounted without any or without noticeable radial play relative to the crankshafts 1 and 4.

The apparatus of FIG. 1 further comprises a first camshaft 10 which is spaced apart from and parallel with the crankshafts 1 and 4. The shafts 1 and 10 form part of that unit or section of the internal combustion engine which is continuously driven, i.e., the camshaft 10 rotates when the crankshaft 1 receives torque from the corresponding cylinder or cylinders of the internal combustion engine. The means for transmitting torque between the shafts 1 and 10 comprises a gear train including a rotary member here shown as a spur gear 14 which is mounted on and drives the camshaft 10 and receives torque from a pinion 14*a* of or on the crankshaft 1. The camshaft 10 can accelerate the crankshaft 4 by way of a second camshaft 13 which is coaxial with the camshaft 10 and can be coupled to the camshaft 10 by a second clutch (called accelerating clutch) shown in the middle of the lower part of FIG. 1. This second clutch includes the parts which are denoted by reference characters 11, 12, 20, 17, 46 and 47 and will be described in greater detail below. The means for engaging the second clutch comprises a speed comparing device which, at the will of the driver of the vehicle, actuates the second clutch when the speed of the first camshaft 10 deviates from the speed of the second camshaft 13. In accordance with a presently preferred embodiment of the invention, the just mentioned speed comparing device includes an oil pump, e.g., a gear pump which causes oil or another liquid to flow into an annular chamber 19 along a path 36, 37, 38, 39 when the speed of the camshaft 10 deviates from the speed of the camshaft 13. The liquid in the chamber 19 acts upon an annular piston 20.

Figure 2:
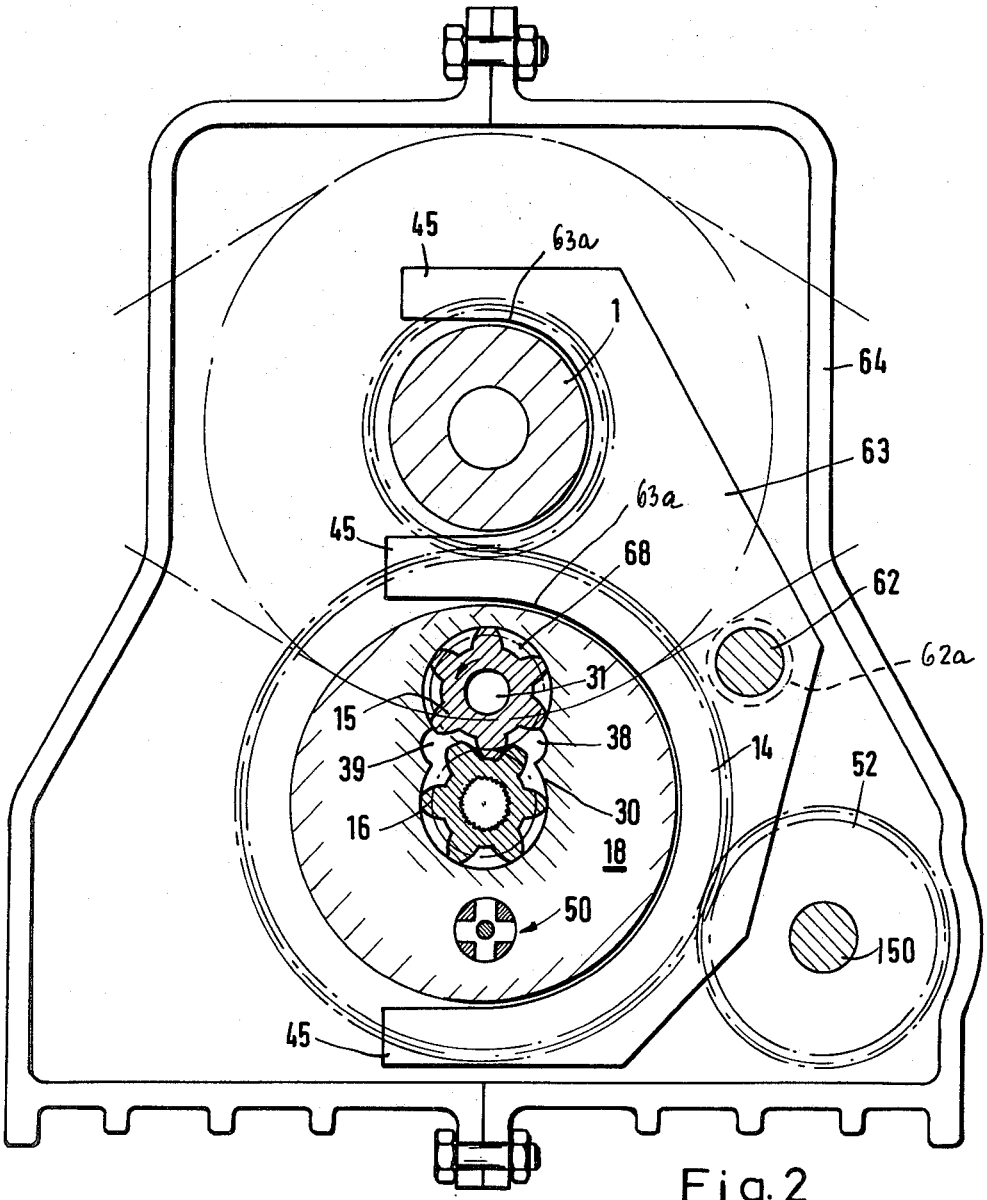
FIG. 2 is a transverse sectional view as seen in the direction of arrows from the line II—II of FIG. 1.

That side of the gear 14 which faces the camshaft 13 has a recess 30 for a gear 15 which forms part of the oil pump and is mounted on a shaft 31 one end portion of which is rotatably journalled in the gear 14 (see FIG. 1). The gear 15 meshes with a further gear 16 which also forms part of the oil pump and is non-rotatably secured to the left-hand end portion of the camshaft 13 (as viewed in FIG. 1), i.e., to that end portion of the camshaft 13 which is nearest to the camshaft 10. The camshafts 10 and 13 are coaxial with each other. The gear 16 is also located in the recess 30 of the gear 14, and the dimensions of the recess 30 are selected in such a way (see FIG. 2) that the surface surrounding this recess is closely adjacent to the top lands of teeth on the gears 15 and 16. In other words, the teeth of the gears 15, 16 define with the surface surrounding the gears 15, 16 a plurality of discrete compartments 68 wherein oil flows from an inlet opening or port 38 to an outlet opening or port 39 (see FIG. 2) when the rotational speed of the gear 14 deviates from that of the gear 16, i.e., when the orbital movement of the gear 15 about the axis of the gear 16 entails an angular displacement of the gears 15, 16 relative to each other. The port 39 discharges into the aforementioned annular chamber 19 for the annular piston 20. Thus, the teeth of the gears 15 and 16 act not unlike vanes which convey the hydraulic fluid from the port 38 to the port 39 when the gears 15, 16 rotate relative to each other. As shown in FIG. 2, the ports 38 and 39 are disposed at the opposite sides of the plane including the axes of the gears 15 and 16. When the gear 15 rotates in a counterclockwise direction (as viewed in FIG. 2), the gear 16 rotates in the same direction which means that the teeth of the gears advance discrete batches of liquid from the port 38, along the upper portion of the surface bounding the recess 30 and toward the port 39 as long as the gears 15, 16 turn relative to each other. At the same time, the teeth of the gear 16 transport batches of liquid from the port 38, along the lower part of the surface bounding the recess 30, and such batches merge with the batches supplied by the gear 15 prior to entering the port 39. Since the chamber 19 normally does not allow for escape of liquid except via port 39, the liquid which is pumped into the chamber 19 via port 39 displaces the piston 20 in a direction to the right, as viewed in FIG. 1, whereby the accelerating clutch couples the continuously rotating camshaft 10 with the second camshaft 13. The teeth or vanes of the gears 15, 16 draw liquid from a source (not shown) via suction channels 36, 37. The source is preferably the oil sump of the engine, i.e., there is no need to provide a separate source of liquid to be fed into the chamber 19. The sump (source of fluid) is shown in FIG. 1.

The right-hand side of the recess 30 (as viewed in FIG. 1) is overlapped by a cover or lid 18 which serves as a bearing member for the other end portion of the shaft 31 for the gear 15. Furthermore, the lid 18 has a central opening 32 for the left-hand end portion of the camshaft 13. Still further, the lid 18 has two concentric annular projections or ribs 33 and 34 the latter of which spacedly surrounds the former. The projections or ribs 33 and 34 define the aforementioned annular chamber 19 for the annular piston 20. The piston 20 is movable axially but is held against rotation in the chamber 19, i.e., the piston 20 shares the angular movements of the camshaft 10 and gear 14. When the speed of the camshaft 10 differs from the speed of the camshaft 13, the piston 20 is moved in a direction to the right, as viewed in FIG. 1, to thereby expose one or more liquid discharging openings in the annular projection or rib 33 and/or 34. In the embodiment of FIGS. 1–2, the projections 33, 34 are formed with liquid discharging openings 40, 41, 42 and 43. The openings 40 and 43 are provided in the outer projection 34 and the openings 41, 42 are provided in the inner projection 33. These openings return the liquid into the oil sump. In such axial position, the piston 20 urges one or more friction discs 12 against a clutch element 11 which is non-rotatably secured to the camshaft 13. Consequently, angular movements of the gear 14 and camshaft 10 are transmitted to the camshaft 13 whereby the latter rotates a gear 65 which, in turn, drives the crankshaft 4. When the speed of the camshaft 13 at least approximates the speed of the camshaft 10, the extent of angular movement of the gear 15 relative to the gear 16 is negligible or zero which means that the chamber 19 ceases to receive liquid via port 39. Therefore, a spring 28 which is mounted in the gear 65 can push the piston 20 against the left-hand end of the chamber 19, as viewed in FIG. 1, i.e., the accelerating clutch between the camshafts 10 and 13 is disengaged. The spring 28 is or may constitute a dished spring the marginal portion of which is fixedly connected with the gear 65 on the camshaft 13 and the innermost portion of which bears against the clutch element 11 so that the latter is biased in a direction to the left, as viewed in FIG. 1, i.e., toward the piston 20. When the piston 20 moves in a direction toward the gear 14 on the camshaft 10, it expels the liquid from the chamber 19, e.g., by way of a one-way valve 50 which can be actuated (opened) by the piston 20 when the latter assumes a predetermined axial position under the action of the spring 28. Opening of the valve 50 entails practically instantaneous escape of liquid from the chamber 19. The spring 28 urges the clutch element 11 in a direction toward the gear 14, and this clutch element rotates at or close to the speed of the gear 14 when the piston 20 opens the valve 50. This moves a projection or lobe 47 on the clutch element 11 into an opening or groove 46 when the camshaft 13 assumes a predetermined angular position with reference to the camshaft 10. The groove 46 is machined into or otherwise formed in a ring-shaped clutch element 17 connected to that side of the gear 14 which faces the camshaft 13. It is advisable to install a torsion damping or shock absorber device, e.g., a torsion spring 27, between the gear 14 and the ring-shaped element 17 so that the latter can turn through a predetermined angle with reference to the gear 14 in order to ensure that the projection or lobe 47 can enter the groove 46. Moreover, the torsion spring 27 can take up the initial stress when the lobe 47 penetrates into the groove 46 and the clutch element 11 begins to receive torque from the clutch element 17. It is clear that a torsion damping means in the form of a spring or the like can be installed at any desired locus of the path for transmission of torque from the camshaft 10 to the gear 65 on the camshaft 13.

As shown in FIG. 2, the apparatus which embodies the invention further comprises a plate-like control member 63 which has three fingers or arms 45 and defines two substantially semicylindrical sockets **63*a*, namely, a first socket between the two upper arms 45, and a second socket between the two lower arms 45, as viewed in FIG. 2. The upper half of the control member 63 can enter complementary grooves or depressions 61 in the periphery of the clutch member 7, and the lower half of the member 63 can enter complementary grooves or depressions 60 in the periphery of the clutch element 11. The purpose of the control member 63 is to ensure that the movements of the clutch member 7 are shared by movements of the clutch element 11 and vice versa, always to the same extent. Thus, and as already mentioned above, when the spring 28 is free to move the clutch element 11 in a direction to the left, as viewed in FIG. 1, because the RPM of the camshaft 13 matches or approximates the RPM of the camshaft 10, the control member 63 acts as a motion transmitting means and moves the clutch member 7 axially toward the crankshaft 1, i.e., toward the clutch member 5. This means that the profile 8 of the clutch member 7 engages the profile 6 of the clutch member 5 so that the crankshaft 1 drives the crankshaft 4. The control member 63 is mounted on and is movable in the axial direction of a shaft 62 which is parallel to the shafts 1, 4, 10 and 13. A coil spring 62*a* or other resilient or otherwise yieldable biasing means is provided to permanently urge the control member 63 to a predetermined position (as considered in the axial direction of the shaft 62), namely, to a starting position in which the clutch member 7 is disengaged from the clutch member 5 and, therefore, the clutch element 11 is disengaged from the composite clutch element including the gear 14 and the ring-shaped element 17 on the gear 14**.

The operation of the apparatus which is shown in FIGS. 1 and 2 is as follows:

It is assumed that the internal combustion engine section or unit which includes the crankshaft 1 and the camshaft 10 is operative so that the crankshaft 1 rotates the gear 14 which drives the camshaft 10. Such situation can develop immediately after starting of the internal combustion engine. The control member 63 is then held in a position in which its upper and median fingers or arms 45 maintain the clutch member 7 out of engagement with the clutch member 5 and the median and lower fingers or arms 45 maintain the clutch element 11 out of engagement with the gear 14. In other words, the clutch including the clutch members 5, 7 is disengaged and the accelerating clutch including the piston 20 and the friction discs 12 is also disengaged. The piston 20 is held in the axial position of FIG. 1, and the chamber 19 for the piston 20 receives pressurized liquid because the gear 15 rotates relative to the gear 16, i.e., because the camshaft 10 rotates relative to the camshaft 13. If the camshaft 13 is to receive torque from the camshaft 10, the control member 63 is released for movement in the axial direction of the shaft 62, e.g., by means of a lever, pedal or an analogous actuating element (not shown), so that the spring 28 is free to move the clutch element 11 axially toward the piston 20. The piston 20 rotates with the gear 14, and such angular movement is transmitted to the clutch element 11 via friction discs 12. The camshaft 13 is accelerated so that its speed ultimately approximates or matches the speed of the camshaft 10 which is driven by the crankshaft 1. When the speed of the camshaft 13 at least approximates that of the camshaft 10, the extent of angular movement between the gears 15, 16 is reduced to zero or close to zero so that the gears 15, 16 cease to force additional liquid into the chamber 19. Therefore, the spring 28 can push the clutch element 11 in a direction to the left and the piston 20 is displaced by the clutch element 11 to actuate the valve 50 which abruptly allows the liquid to leave the chamber 19. This enables the lobe 47 to enter the groove 46 of the ring-shaped element 17 to thus establish a positive formlocking connection between the elements of the accelerating clutch intermediate the camshafts 10 and 13. Moreover, penetration of the lobe 47 into the groove 46 ensures that the clutch element 11 is located in a predetermined angular position with reference to the gear 14 and camshaft 10. Axial movement of the clutch element 11 in a direction to introduce the lobe 47 into the groove 46 is shared by the clutch member 7 which moves into engagement with the clutch member 5 because any axial movements of the element 11 must be shared by the member 7 owing to the provision of the control member 63. The crankshafts 1 and 4 then rotate in unison. This corresponds to normal operation of the engine, i.e., when the engine is operated at maximum or full load and each of the two crankshafts 1, 4 is driven by the respective group of cylinders of the internal combustion engine.

If the crankshaft 4 is to be disengaged from the crankshaft 1, e.g., when the engine is to be operated at partial load, the control member 63 is moved back to the illustrated position (for example, through the medium of the aforementioned lever, pedal or the like) so that the clutch including the components 11, 12 and 20 ceases to transmit torque. Also, the control member 63 disengages the profile 8 of the clutch member 7 from the profile 6 of the clutch member 5.

An important advantage of the improved apparatus is that, once the camshaft 13 is coupled to the camshaft 10, the camshaft 13 can accelerate the second crankshaft 4 via gears 65, 65*a* and the ratio of rotational speeds of the camshafts 10, 13 determines the timing of possible coupling of the crankshaft 4 to the crankshaft 1. Otherwise stated, positive engagement between the profiles 6, 8 of the clutch members 5, 7 can take place only subsequent to positive engagement between the clutch elements 11 and 17 (i.e., subsequent to penetration of the lobe 47 into the groove 46). The accelerating clutch (including the piston 20, discs 12 and clutch element 11) allows the camshaft 10 to rotate relative to the camshaft 13 while the latter is in the process of being accelerated to the angular velocity of the camshaft 10, the camshaft 13 is positively coupled to the camshaft 10 (by the lobe 47) when the angular velocity of the camshaft 13 is sufficiently high to match or closely approximate the angular velocity of the shaft 10 (i.e., when the RPM of the crankshaft 4 is sufficiently close to the RPM of the crankshaft 1 to warrant safe engagement of the profiles 6 and 8), and the crankshaft 4 is positively coupled to the crankshaft 1 when the difference between the speeds of the shafts 1 and 4 is zero or sufficiently small to enable the teeth 6*a*, 8*a* to respectively penetrate into the tooth spaces 8*b*, 6*b*.

The invention can be embodied with advantage in four-cycle internal combustion engines wherein the camshaft always completes one revolution for the firing of the cylinders whereas the crankshaft completes two revolutions for each ignition or working stroke of the cylinders. The improved apparatus allows for proper coupling of the camshafts 10, 13 to each other so as to ensure the firing of cylinders in proper sequence. The apparatus renders it possible to properly couple the crankshafts 1 and 4 to each other in spite of the fact that proper coupling must take place within an angle of 720 degrees rather than merely 360 degrees. Were the accelerating clutch placed between the crankshafts 1 and 4, it would be necessary to provide rather costly, bulky and sensitive additional control equipment in order to prevent coupling of the crankshaft 4 to the crankshaft 1 in a position at 360 degrees from the desired position.

The incorporation of our improved apparatus in an internal combustion engine not only brings about savings in fuel but also reduces the quantity of deleterious combustion products which are discharged into the atmosphere by conventional engines wherein all of the cylinders are operated if one of the cylinders is in operation, i.e., which do not allow for selective activation or deactivation of one or more groups of cylinders. The number of cylinders which cooperate with the crankshaft 1 may but need not be identical with the number of cylinders which rotate the crankshaft 4. This depends on the desired distribution of loads, i.e., on the desired ratio of partial load (some of the cylinders are in use) to maximum or full load when all of the cylinders are in action.

The speed monitoring and comparing means including the gears 15, 16 ensures that the spring 28 is free to move the clutch element 11 in a direction toward the gear 14 and to such an extent that the lobe 47 penetrates into the groove 46 only at a time when the speed of the camshaft 13 matches or closely approximates the speed of the camshaft 10. The speed of the shaft 10 is one-half the speed of the crankshaft 1, and the speed of the crankshaft 4 is twice the speed of the camshaft 13. Thus, the diameter of the gear 65*a* on the end portion 3 of the crankshaft 4 is half the diameter of the gear 65. Therefore, penetration of the lobe 47 into the groove 46 automatically ensures that the angular position of the crankshaft 4 relative to the crankshaft 1 is proper (within the angle of 720 degrees) when the profile 8 is free to move into positive engagement with the profile 6.

An advantage of the valve 50 is that it can provide a relatively large path for escape of liquid from the chamber 19 as soon as the spring 28 is free to move the piston 20 to an axial position in which the latter opens the valve 50. This insures that the piston 20 need not expel liquid from the chamber 19 by way of relatively narrow port 39, i.e., along the path 36–39 which admits liquid into the chamber 19 while the piston 20 moves toward the position of engagement with the friction discs 12, i.e., toward the position in which the accelerating (friction) clutch transmits torque from the camshaft 10 to the camshaft 13.

The control member 63 is shiftable between three different positions, namely, a first position in which the engine operates in the partial load range because the member 63 prevents the friction discs 12 from bearing against the clutch element 11 even if the piston 20 assumes its rightmost position, as viewed in FIG. 1; a second position in which the piston 20 can accelerate the camshaft 10 via friction discs 12; and a third position (full load) in which the clutch member 7 positively engages the clutch member 5 as a result of engagement between the profiles 6 and 8.

The structure which is shown in FIGS. 1 and 2 can also be used to drive one or more pieces of auxiliary equipment. Thus, the camshaft 10, which is rotated whenever the engine drives the crankshaft 1, can transmit torque to a rotary member 51, such as a pulley or a sprocket wheel, by way of a gear 52, which is driven by the gear 14, and a shaft 150 which connects the gear 52 with the rotary member 51 and is journalled in the casing or housing 64 for the clutches or in the cylinder block of the engine.

Figure 3:
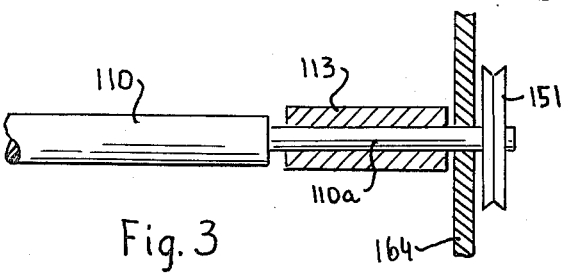
FIG. 3 is a fragmentary partly elevational and partly longitudinal sectional view of a modified apparatus.

Instead of the just described power takeoff, the constantly driven camshaft can transmit motion to a modified takeoff in a manner as illustrated in FIG. 3. The camshaft 13 of FIG. 1 is replaced with a hollow camshaft 113 which surrounds an extension 110*a* of the constantly driven camshaft 110 replacing the camshaft 10. The extension 110*a* is journalled in the housing 164 for the clutches or in the cylinder block and rotates a pulley, a gear, a cam, a sprocket wheel or any other suitable rotary member 151.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for connecting and disconnecting first and second sections of an internal combustion engine, comprising coaxial first and second rotary crankshafts having end portions which are adjacent to each other, said first and second crankshafts respectively forming part of said first and second sections; accelerating means operable to raise the speed of said second crankshaft to at least approximate the speed of said first crankshaft; and clutch means operative to positively couple said crankshafts to each other upon completed acceleration of said second crankshaft, said clutch means comprising a first clutch member driven by the end portion of said first crankshaft and having a first profile facing said second crankshaft, a second clutch member driven by the end portion of said second crankshaft and having a second profile complementary to said first profile, means for axially movably securing at least one of said clutch members to the respective crankshaft so that the profile of said one clutch member can move into and from positive engagement with the profile of the other of said clutch members in response to axial movement of said one clutch member relative to said crankshafts, and control means for moving said one clutch member toward said other clutch member to thereby positively engage said profiles in response to completed acceleration of said second crankshaft.

2. The apparatus of claim 1, wherein said control means is movable between first and second positions in which the profile of said one clutch member respectively engages with and is disengaged from the profile of said other clutch member, and further comprising means for maintaining said control means in said second position while the angular velocity of said second crankshaft deviates from the angular velocity of said first crankshaft.

3. The apparatus of claim 2, further comprising means for moving said control means to said first position in response to completed acceleration of said second crankshaft to the angular velocity of said first crankshaft.

4. The apparatus of claim 3, wherein said accelerating means comprises a first camshaft receiving torque from said first crankshaft and a second camshaft arranged to drive said second crankshaft, the angular velocities of said first and second camshafts being respectively proportional to the angular velocities of said first and second crankshafts and said means for moving said control means to said first position including means for monitoring the angular velocities of said camshafts.

5. The apparatus of claim 4, further comprising means for holding said control means against movement to said first position except in a predetermined angular position of said second camshaft with reference to said first camshaft.

6. The apparatus of claim 1, wherein said one clutch member is said second clutch member.

7. The apparatus of claim 6, wherein said securing means includes resilient means connecting said second clutch member to the end portion of said second crankshaft, said resilient means being operative to urge said second profile in the axial direction of said crankshafts and away from said first profile.

8. The apparatus of claim 7, wherein said resilient means includes means for holding said second clutch member against rotation with respect to said second crankshaft.

9. The apparatus of claim 8, wherein said resilient means comprises a first spring having a first portion connected with the end portion of said second crankshaft and a second portion located radially outwardly of said first portion, a second spring having a first portion connected with said second clutch member and a second portion located radially outwardly of the respective first portion, and a connector securing the second portions of said springs to each other.

10. The apparatus of claim 9, wherein said springs are ring shaped springs having inner marginal portions which constitute the respective first portions and outer marginal portions which constitute the respective second portions.

11. The apparatus of claim 1, further comprising means for centering said one clutch member with respect to said other clutch member and said crankshafts with freedom of axial movement of said one clutch member relative to said other clutch member.

12. The apparatus of claim 11, wherein said clutch members have end faces facing each other and axial bores in said end faces, said centering means including a member anchored in one of said bores and reciprocably extending into the other of said bores.

13. The apparatus of claim 12, wherein said centering means further comprises a cylindrical bearing provided in said other bore and surrounding said member of said centering means.

14. The apparatus of claim 12, wherein said member of said centering means is a hollow cylinder which is anchored in the bore in the end face of said second clutch member, said second clutch member constituting said one clutch member.

15. Apparatus for connecting or disconnecting first and second sections of an internal combustion engine, comprising first and second rotary crankshafts respectively forming part of said first and second sections; accelerating means operable to raise the speed of said second crankshaft to at least approximate the speed of said first crankshaft; first clutch means operative to positively couple said crankshafts to each other upon completed acceleration of said second crankshaft; a first rotary camshaft driven by said first crankshaft; a second rotary camshaft coaxial with said first camshaft and arranged to drive said second crankshaft, the rotational speeds of said first and second crankshafts being respectively proportional to rotational speeds of said first and second camshafts and said accelerating means including second clutch means interposed between said camshafts; and means for monitoring the speeds of said camshafts and for effecting disengagement of said second clutch means when the speed of said second camshaft matches or closely approximates the speed of said first camshaft.

16. The apparatus of claim 15, wherein said monitoring means includes a pump for a hydraulic fluid.

17. The apparatus of claim 16, further comprising a source of hydraulic fluid, said second clutch means comprising a device provided on said first camshaft and defining a cylinder chamber, a piston reciprocable in said chamber between first and second positions in which said second clutch means is respectively engaged and disengaged, and means for rotating said second camshaft at an increasing speed in response to movement of said piston from said second to said first position, said pump including means for conveying fluid from said source into said chamber to thereby move said piston from said second toward said first position as long as the speed of said first camshaft exceeds the speed of said second camshaft.

18. The apparatus of claim 17, wherein said piston is arranged to rotate with said first camshaft and said means for rotating said second camshaft includes means for transmitting torque from said piston to said second camshaft at a rate which increases with progressing movement of said piston from said second toward said first position thereof.

19. The apparatus of claim 17, wherein said pump further comprises a rotary member arranged to share the angular movements of said first camshaft and having an end face facing said second camshaft and provided with a recess, said fluid conveying means comprising a first gear rigid and coaxial with said second camshaft and extending into said recess and a second gear rotatably mounted in said rotary member and meshing with said first gear, said second gear being arranged to orbit about said first gear and to cooperate therewith so as to draw fluid from said source into said chamber while said first and second gears rotate relative to each other.

20. The apparatus of claim 19, wherein said rotary member has a surface closely surrounding the teeth of said gears in said recess and defining with said teeth a plurality of compartments for the transport of fluid from said source toward said chamber as long as said gears rotate relative to each other.

21. The apparatus of claim 19, wherein said recess is eccentric with reference to said second camshaft.

22. The apparatus of claim 19, wherein said pump further comprises a lid overlying said recess and having an opening for said second camshaft, said second gear being journalled in said lid.

23. The apparatus of claim 22, wherein said lid constitutes said device which defines said chamber.

24. The apparatus of claim 23, wherein said lid comprises two concentric annular projections and said chamber is disposed between said projections.

25. The apparatus of claim 24, wherein said projections face said second camshaft.

26. The apparatus of claim 17, wherein said device has at least one fluid discharging opening which communicates with said chamber and is sealed by said piston except in said first position thereof so that the fluid which is supplied by said pump can escape from said chamber when said camshafts rotate at identical speeds.

27. The apparatus of claim 26, wherein said means for rotating said second camshaft in response to movement of said piston from said second position comprises a clutch element non-rotatably secured to said second camshaft and friction generating means interposed between said piston and said clutch element, said clutch element being movable axially of said camshafts.

28. The apparatus of claim 27, wherein said first mentioned clutch means comprises a first clutch member driven by said first crankshaft and a second clutch member coaxial with said first clutch member and driven by said second crankshaft, said second clutch member being movable axially of said crankshafts into and from positive engagement with said first clutch member, and further comprising control means connected with said second clutch member and with said clutch element and arranged to move said second clutch member into positive engagement with said first clutch member and to simultaneously move said clutch element toward said first camshaft when said piston reaches said first position whereby the piston expels fluid from said chamber on the way toward said second position thereof.

29. The apparatus of claim 28, further comprising normally closed valve means actuatable by said piston during movement toward said second position to allow for abrupt expulsion of fluid from said chamber.

30. The apparatus of claim 28, further comprising means for biasing said clutch element in a direction toward said piston so as to enable said control means to engage said second clutch member with said first clutch member.

31. The apparatus of claim 15, wherein said second clutch means comprises a first clutch element coaxial with and driven by said first camshaft and a second clutch element coaxial with and driving said second camshaft, one of said clutch elements being movable axially toward and away from the other of said clutch elements and said second clutch means further comprising means for moving said one clutch element toward said other clutch element in response to completed acceleration of said second camshaft to the speed of said first camshaft, one of said clutch elements having a projection and the other of said clutch elements having an opening arranged to receive said projection in a predetermined angular position of said second camshaft relative to said first camshaft.

32. The apparatus of claim 31, further comprising control means arranged to positively engage said first mentioned clutch means in response to entry of said projection into said opening.

33. The apparatus of claim 31, wherein said opening is a groove provided in said first clutch element.

34. The apparatus of claim 33, further comprising means for transmitting torque from said first crankshaft to said first camshaft, said torque transmiting means comprising a gear coaxial with said first camshaft and said first clutch element being mounted on and being coaxial with said gear.

35. The apparatus of claim 34, wherein said first clutch element is rotatable, within limits, relative to said gear, and further comprising resilient shock absorber means interposed between said gear and said first clutch element and being operative to yieldably oppose rotation of said first clutch element relative to said gear.

36. The apparatus of claim 15, wherein said first mentioned clutch means comprises coaxial first and second clutch members respectively driven by said first and second crankshafts, one of said clutch members being movable toward and away from positive engagement with the other of said clutch members and said second clutch means comprising coaxial first and second clutch elements between said camshafts, means for rotating said first clutch element in response to rotation of said first camshaft, means for rotating said second camshaft in respone to rotation of said second clutch element by said first clutch element, and means for maintaining said clutch element in progressively increasing frictional torque transmitting engagement during acceleration of said second camshaft to the speed of said first camshaft, and further comprising control means for moving said one clutch member into engagement with said other clutch member in response to completed acceleration of said second clutch element to the speed of said first clutch element.

37. The apparatus of claim 36, wherein said control means comprises a control member reciprocable in parallelism with the axes of said camshafts and means for rotatably coupling said one clutch member and said second clutch element to said control member so that any movement of said control member with said second clutch element in the axial direction of said camshafts entails a corresponding movement of said one clutch member and vice versa.

38. The apparatus of claim 37, wherein said one clutch member has a first circumferential groove and said second clutch element has a second circumferential groove, said coupling means comprising arms provided on said control member and extending into said grooves.

39. The apparatus of claim 37, wherein said control member is movable to a position in which said second clutch element is disengaged from said first clutch element and said one clutch member is disengaged from said other clutch member.

40. Apparatus for connecting or disconnecting first and second sections of an internal combustion engine, comprising first and second rotary crankshafts respectively forming part of said first and second sections; accelerating means operable to raise the speed of said second crankshaft to at least approximate the speed of said first crankshaft; first clutch means interposed between said crankshafts and operative to positively couple said crankshafts to each other upon completed acceleration of said second crankshaft; a first camshaft; means for rotating said first camshaft in response to rotation of said first crankshaft; a second camshaft; means for rotating said second crankshaft in response to rotation of said second camshaft, said accelerating means including second clutch means interposed between said camshafts, said camshafts and said second clutch means constituting with the means for rotating said second camshaft a power train which rotates said second crankshaft in response to rotation of said first crankshaft in at least partly engaged condition of said second clutch means; and torsion damping shock absorber means installed in said power train.

41. The apparatus of claim 40, wherein said shock absorber means is installed in the power train between said means for rotating said first camshaft and said means for rotating said second crankshaft.

42. The apparatus of claim 41, wherein said means for rotating said first camshaft comprises a first gear train and said means for rotating said second crankshaft comprises a second gear train.

* * * * *

UNITED STATES PATENT AND TRADEMARK OFFICE

CERTIFICATE OF CORRECTION

PATENT NO. : 4,389,985

DATED : June 28, 1983

INVENTOR(S) : Lothar HUBER et al.

It is certified that error appears in the above-identified patent and that said Letters Patent are hereby corrected as shown below:

Foremost page [30], "2005369" should read --3005369--.

Signed and Sealed this

*Thirtieth* Day of *April 1985*

[SEAL]

*Attest:*

DONALD J. QUIGG

*Attesting Officer*

*Acting Commissioner of Patents and Trademarks*